United States Patent [19]

Canham

[11] 4,053,955

[45] Oct. 18, 1977

[54] DRAIN CLEANING TOOL

[76] Inventor: Morris H. Canham, 621 E. Prospect, Kewanee, Ill. 61443

[21] Appl. No.: 645,989

[22] Filed: Jan. 2, 1976

[51] Int. Cl.[2] ..... E03D 11/00

[52] U.S. Cl. ..... 4/255; 310/30; 417/416

[58] Field of Search ..... 4/255, 256, 257; 310/30, 29, 28, 15; 417/415, 416, 417, 418

[56] References Cited

U.S. PATENT DOCUMENTS

| | | | |
|---|---|---|---|
| 950,549 | 3/1910 | Kurrus | 4/255 |
| 1,680,460 | 8/1928 | Langdon | 4/256 |
| 2,222,823 | 11/1940 | Parenti | 417/417 |
| 2,241,364 | 5/1941 | Hulbert | 310/30 |
| 2,801,591 | 8/1957 | Parker | 417/417 |
| 3,253,742 | 5/1966 | Sanders et al. | 417/416 |
| 3,488,614 | 1/1970 | Macy | 335/264 |
| 3,498,329 | 3/1970 | McCormick | 310/15 |
| 3,851,342 | 12/1974 | Moore | 4/256 |

*Primary Examiner*—Richard E. Aegerter
*Assistant Examiner*—John W. Shepperd

[57] ABSTRACT

An hydraulic plunger for cleaning a clogged drain composed of a casing with a piston movable therein and being open at one end. A fitting is provided on the open end that fits against the drain inlet. A water inlet is provided in the casing to permit water to fill the casing on the side of the piston that is open to the drain pipe and the drain pipe to the stoppage therein. An electromagnetic unit is carried within the casing and has a driven member that strikes the piston to create a relatively large impact force against the water and stoppage in the drain.

5 Claims, 5 Drawing Figures

DRAIN CLEANING TOOL

BACKGROUND OF THE INVENTION

It has heretofore been known to provide drain cleaning tools for breaking stoppages in clogged drains that consisted of a casing with a piston therein which opens into a clogged drain. The casing has a connection to a water main that fills the casing on the one side of the piston and the drain to the stoppage. Pressure is exerted on the opposite side of the piston by means of water pressure or air pressure. Such designs of drain cleaning tools are shown, for example, in U.S. Pat. Nos. 2,733,450 and 1,903,735.

One of the problems that exists with respect to this type of drain cleaner is in one instance where air is used there must be a source of pressurized air. In either case, whether air or water is used, there will be a gradual increase of pressure against the piston. Often if the drain blockage is sufficiently large there will not be enough pressure generated by either air or water.

SUMMARY OF THE INVENTION

With the above in mind it is a primary object to provide a solenoid or an electromagnetic unit within the casing that engages the piston to force water through the drain pipe. It is contemplated that a lost motion action will occur between the driving element of the electromagnetic member and the piston so that there will be an anvil-type of striking action against the piston which will cause a shock reaction in the water in the drain and on the opposite side of the piston.

It is a further object of the invention to provide with the above electromagnetic unit a switch on the handle of the casing so that an operator of the unit may turn the switch to the electromagnetic unit on and off at will so as to continuously cause the striking action of the solenoid.

It is still a further object of the present invention to provide a water inlet to the casing on the water side of the piston with a spring loaded one-way valve therein. Consequently, as water is needed in the casing and the drain, the one-way valve will permit the water to enter. However, once the casing and drain pipe to the blockage are full of water, the one-way valve will seat and any buildup of pressure against the water in the casing and drain pipe will be created by the impact as the solenoid member strikes the piston. Since the inlet will normally be connected to a hose which in turn is connected to a faucet, there will always be the pressure of the water line against the blockage. Upon the blockage beginning to disintegrate, the pressure of the water line tend to flush the blockage from the drain. Should the piston tend to move the blockage upon the return stroke of the piston, the one-way valve will permit the water to again fill the casing. Thus, the switch for the solenoid in cooperation with the one-way valve permits the operator of the unit to continuously create impact forces on the blockage.

A further object of the present invention is to provide an adjustment in the control mechanism for the electromagnetic unit so as to permit variation in the impact force of a member striking the piston.

DESCRIPTION OF THE PREFERRED EMBODIMENT

Figure 2:
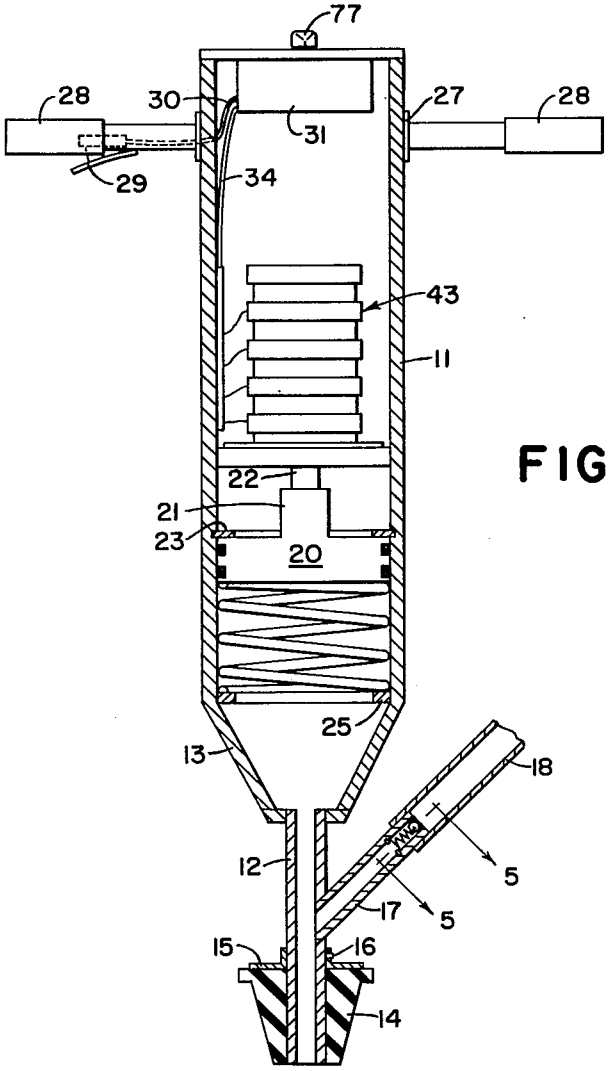
FIG. 2 is a side view of the drain cleaning unit with the casing being shown in vertical section so as to shown internal mechanism within the casing.
Figure 1:
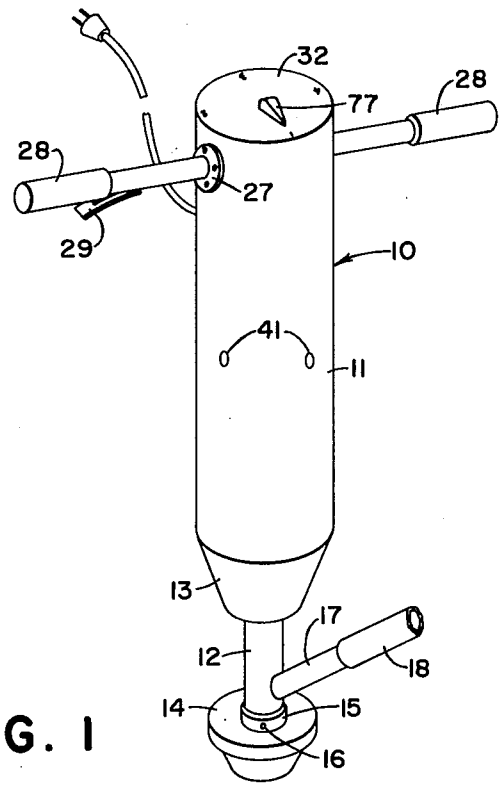
FIG. 1 is a perspective view of the entire drain cleaning unit.
Figure 5:
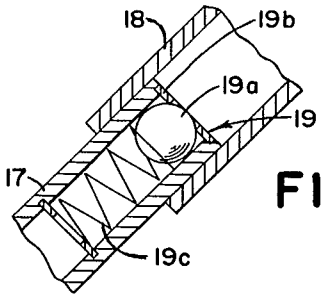
FIG. 5 is an enlarged sectional view of a one-way valve in the pipe portion as taken along the line 5—5 of FIG. 2.

Referring now to the drawings, the plunger device is composed of a main steel casing 10 having a main cylindrical portion 11 and an axially extending comparatively small pipe portion 12 joined with the cylindrical portion 10 by a cone-shaped portion 13. Fixed to the end of the pipe portion 12 is a molded rubber fitting 14 that is adapted to sit against a conventional-type sink drain or floor drain. A metal flange fitting 15 is fixed by set screws 16 to the pipe portion 12 and generally backs against the back side of the rubber fitting 14. The flange 15 operates to limit movement of the rubber fitting 14. It is also clearly apparent that the fitting 14 may be changed to have a different shape or size fitting for a different shape or size of drain. Fixed to the pipe portion 12 at an angle thereto and in communication therewith is a short pipe section 17 on which is mounted a hose 18. Contained in the pipe section 17 at the mouth thereof is a one-way valve 19 composed of a ball **19*a* that seats against a shoulder 19*b* and is biased toward the shoulder by a spring 19*c*. While not shown, the opposite end of the hose may be connected to a faucet so that water may move through the hose, through the pipe section 17 and into the pipe portion 12.**

Disposed within the cylindrical portion 11 of the casing 10 is a piston 20 having a pair of annular surface grooves that receive O-rings that serve to prevent leakage around the piston 20. The piston has on its upper sides a boss section 21 that receives the lower end of a plunger 22, the purpose of which will later become apparent. The casing 10 receives a snap ring or stop 23 that bears against the upper side of the piston 20 and limits its axial movement. Provided on the opposite side of the piston 20 is a spring 24 that bears against an annular shoulder 25 that is fixed to and projects inwardly of the casing section 11. The piston 20 is constructed of a generally lightweight material and the spring 24 serves to hold the piston 20 against the snap ring 23 or in its uppermost position.

Extending through the upper portion of the casing section 11 is a pipe 26 that is held in place on the casing by a pair of snap rings 27 that bear against the respective outer sides of the casing portion 11. The bar 26 is hollow and supports on opposite ends thereof hand grips 28. Beneath one of the hand grips 28 is a manual switch 29 having a wire 30 leading to an electrical control box 31. The control box 31 is fixed to a plate 32 that sits against the end of the casing 10. A series of screws 33 fixes the plate to the end. Extending from the control box 31 is wiring 34 that extends downwardly to a wiring panel 35 fixed on the internal surface of the casing 11 by means of screws 36,37.

Figure 3:
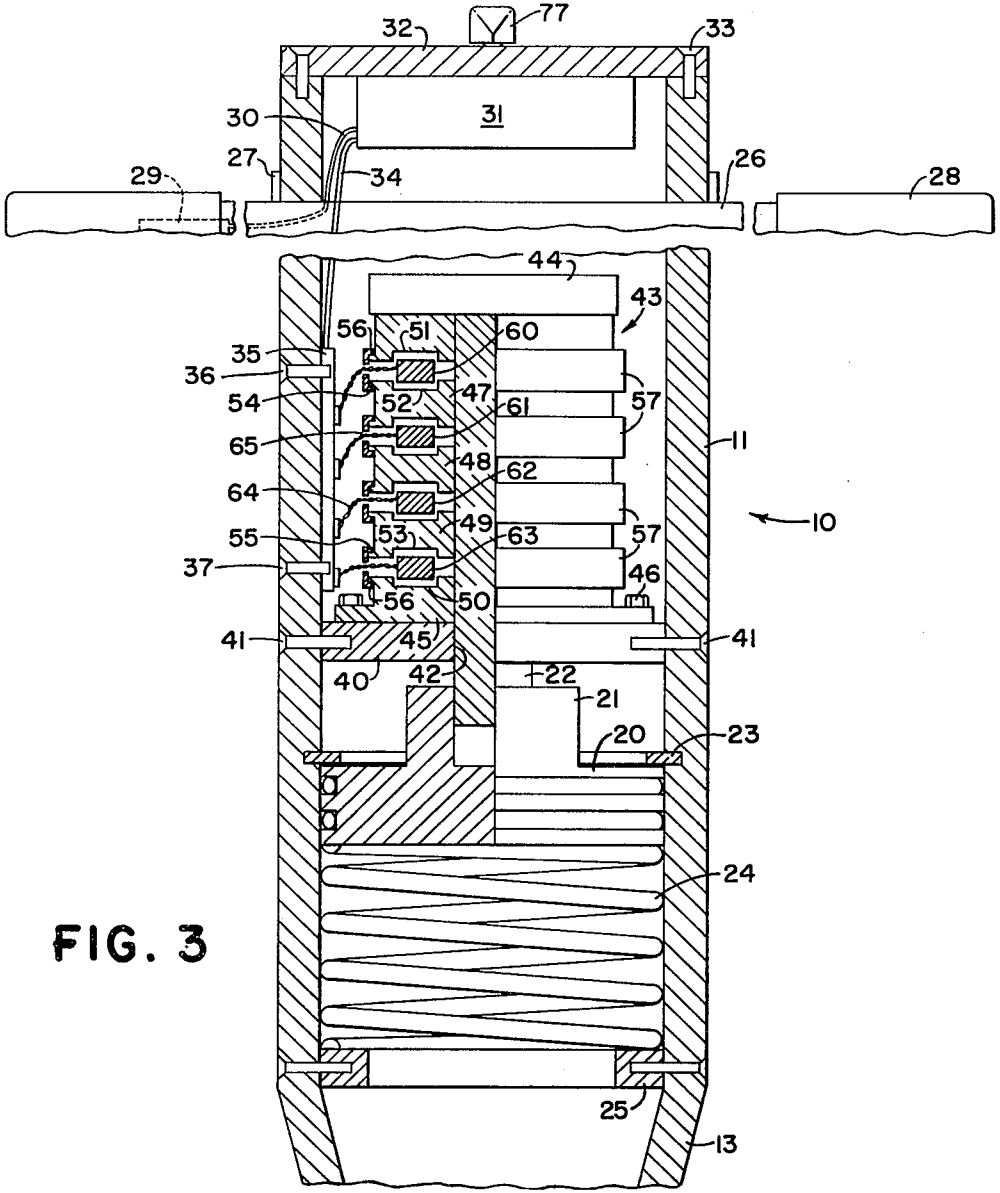
FIG. 3 is an enlarged vertical sectional view of the upper end of the drain cleaning tool showing the electromagnetic unit and its supporting structure.

An annular solenoid carrying plate 40 is fixed internally of the casing portion 11 by means of four mounting screws 41 that extend through the casing portion 11 and into the plate 40. The plate 40 is positioned adjacent the piston 20 and has a central opening 42 through which the plunger shaft 22 extends. Fixed to the upper surface of the plate 40 is a solenoid structure indicated in its entirety by the reference numeral 43. The solenoid structure 43 is composed of an end cap 44 at the uppermost end of the solenoid structure and has fixed thereto the plunger shaft 22. A second end cap 45 is fixed to the lower end of the solenoid structure 43 and is fixed by bolt 46 to the end plate 40. The two caps 44,45 are made of ferromagnetic metal. Stacked to slide axially relative to the plunger shaft 22 are three ferromagnetic disks 47,48,49 that are positioned between the end plates 44,45. The end plate 45 has an upperwardly facing annular recess 50 and the cap 44 has a downwardly facing annular recess 51. There are provided on opposite faces of each disk 47,48,39 annular recesses 52,53 respectively. As may be seen from viewing FIG. 3, the annular recess of the disk 47 is opposite the annular recess 51 and the annular recess 50 of cap 45 is opposite annular recess 53 of the disk 49. As can best be seen in FIG. 2, the disks 47,48,49 have upper and lower outer radial flanges 54,55 respectively, and the cap 44 has on its lower end a radial flange 56 that is opposite the flange 54 of disk 47. Similarly the upper end of the cap 45 has a radial flange 56 that is opposite the lower radial flange of the disk 49. Retaining rings 57 having radial inwardly extending flanges fit over these flanges 54–56 and limit the amount of axial separation that may occur between the caps 44,45 and the disks 47–49.

Seated within the recesses 50–53 are four coils 60,61,62 and 63. The coils are energized by wiring such as at 64 that extends from the wiring panel 35 through suitable slots, such as at 65 in the retainer rings 57.

In operation the electromagnetic plunger for cleaning drains is used in the following manner. The entire tool is placed on a drain so that the fitting 14 rests in both water and air sealing relation to the drain that is to be cleaned. Water is forced through the hose 18 and pipe 17 and into the lower end of the casing 10 until the area beneath the piston 20 is completely filled with water. The valve 19 will retain the water in the housing and drain pipe. The switch 29 is then actuated to cause the electromagnetic unit or solenoid 43 to operate. This is done by energizing the coils 60–63 to the extent believed necessary. The coils cause the cap 44 and ferromagnetic disks 47,48,49 to compress or move downwardly since the cap 45 is fixed in its vertical position. This, of course, forces the plunger shaft 22 downwardly until it engages the piston 20. This gives a shock to the water in the lower end of the casing 10 which will normally break loose the type of stoppage in an average-type drain. It should here be noted that between the lower end of the plunger 22 and the top surface of the cylinder 20 there is a lost motion action where nothing occurs. This permits the solenoid or electromagnetic unit 43 to fully accelerate the plunger shaft 22 prior to it striking the piston 20. This, of course, increases the shock effect of the piston on the water and on the stoppage in the drain pipe.

Figure 4:
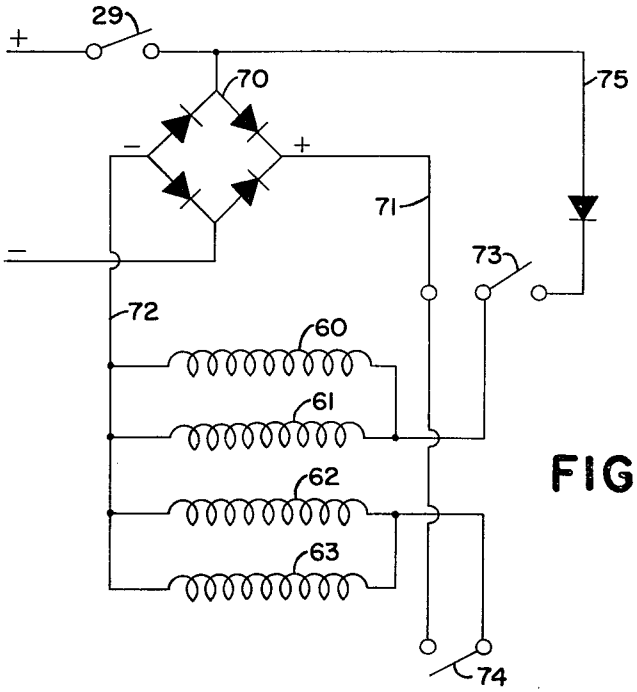
FIG. 4 is a schematic view of the electrical circuit.

The control box 31 provides a circuit to the coils of a type shown in FIG. 4. The circuit operates off of a 110 volt AC electrical source through switch 29. A converter or transformer 70 is provided in the circuit and has a positive outlet wire 71 and a negative wire 72. Extending between the wires 71,72 are the upper pair of coils 60,61 and also the second pair of coils 62,63. A switch 73 is provided between the lines 71 and the coils 60,61 and a switch 74 is provided between the line 71 and the coils 62,63. Also provided in the circuit is a second positive wire 75 that bypasses the converter 70 and extends to the switch 73 so that either AC or DC power may be moved through the upper coils 60,61.

In operation of the solenoid 43, it may be desirable to vary the amount of force created in the solenoid 43. This is done by energizing only a portion or all of the annular coils as desired. For example, should it be desirable to energize only coils 60,61, the switch 73 is moved to its closed position with respect to the transformer line 71. If it is desirable to energize the coils 60,61 by bypassing the converter 70, the switch 73 may be closed directly to the line 75. This will, or course, create greater power in the coils and cause the plunger 22 to open with a greater force when its strikes the piston 20. Similarly, coils 62,63 may be energized along with coils 60,61 by closing the switches 73,74 to the line 71. Likewise, switch 74 may be closed along with switch 73 closing to the wire 75. All of these switches and the circuitry are contained in the control box 31 and the switches, other than main switch 29, are controlled manually by an external knob 77 that is positioned outside of the plate 33. Suitable markings are provided on the plate 32 to indicate the amount of power that the solenoid 43 will apply against the piston 20. The solenoid may be repositioned for further actuation by suitable means in the control box 31.

Referring further to the operation of the unit, it should be understood that as the water moves through the hose 18 by the valve 19, the entire cavity on the outlet side of the piston 20 may be filled with water and when the fitting 14 is properly seated, the drain pipe will also be filled completely with water. It is the purpose of the present electromagnetic unit 43 to strike the piston with a relatively large force so as to break loose the blockage in the drain pipe. Once the blockage begins to move the water behind the one-way valve 19 and from the hose 18 will move into the drain pipe to continue to force or flush the stoppage out of the drain pipe. Therefore, it should be understood that the initial impact of the plunger member 22 against the piston 21 is the important feature of the present invention since it creates a large instantaneous load against the stoppage.

I claim:

1. An hydraulic plunger for cleaning a clogged drain pipe comprising: a casing having an open end, an axially shiftable reciprocal piston retained therein, said piston having a boss on one side thereof with an axial opening therein; an electromagnetic unit in said casing on said one side of the piston and having an axially extending electromagnetically energized driven member with one end thereof seated in the opening of said boss and engageable with the piston, said end being axially offset from the piston to permit the member when energized to shift axially in the opening to thereby accelerate prior to engagement with and shifting of the piston toward the opposite end of said casing; a water inlet to the casing on the opposite side of the piston for passing water into said casing and through said open end; a check valve in the inlet for blocking water from flowing out of said casing via the inlet; a fitting on said casing at said open end and opening into said casing, said fitting being adapted to seat against a drain opening; a stop on the casing engageable with the piston for retaining the piston in axial offset relation with said end of said member; means for shifting the piston against the stop; and control means mounted on said casing for operating the electromagnetic unit in the casing to shift the driven member.

2. The invention defined in claim 1 further characterized by said control means being adjustable to cause said driven member to engage the piston at different but controlled intensities.

3. The invention defined in claim 1 further characterized by a bar being fixed to and extending radially outwardly from the casing to manual gripping means adjacent the bar ends.

4. The invention defined in claim 3 further characterized by an electric switch mounted on the bar adjacent the manual gripping means for operating the electromagnetic means.

5. A plunger for clearing a drain stoppage comprising: a casing having at one end a fitting adapted to seat and seal itself against a drain outlet, said fitting having a central bore extending through the fitting and opening internally to said casing, a piston within and shiftable lengthwise of said casing dividing said casing into a liquid side that is in communication with the bore and an opposite comparatively dry side, said piston having a boss on its dry side with an axial opening therein; an electromagnetic unit within said casing on said dry side and having a central electromagnetically energized and axially extending driving element extending toward the piston, said driving element having an end thereof seated in the opening; a stop in said casing engageable with the piston to limit movement thereof toward said driving element so that the latter is axially offset from the piston and so that a lost motion connection exists between the piston and driving element to thereby permit the element when energized to accelerate prior to said end of the driving element contacting and driving the piston; a switch for operating the electromagnetic unit; a fluid connection for filling the liquid side of said casing with fluid; means for returning the piston to engage the stop, and a check valve for the fluid connection for blocking flow of fluid through the connection.

* * * * *